US008584656B2

(12) United States Patent
Marimbordes et al.

(10) Patent No.: US 8,584,656 B2
(45) Date of Patent: Nov. 19, 2013

(54) SELF-COOLING EXHAUST GAS RECIRCULATION DEVICE FOR AN INTERNAL COMBUSTION ENGINE

(75) Inventors: Thierry Marimbordes, Bazougers (FR); Pascal Noiseau, Saint Ouen des Toits (FR)

(73) Assignee: Mann+Hummel GmbH, Ludwigsburg (DE)

( * ) Notice: Subject to any disclaimer, the term of this patent is extended or adjusted under 35 U.S.C. 154(b) by 819 days.

(21) Appl. No.: 12/781,250

(22) Filed: May 17, 2010

(65) Prior Publication Data

US 2011/0120430 A1 May 26, 2011

(30) Foreign Application Priority Data

May 18, 2009 (FR) ..... 09 53265

(51) Int. Cl.
*F02M 25/07* (2006.01)

(52) U.S. Cl.
USPC ..... 123/568.12; 123/568.17

(58) Field of Classification Search
USPC ..... 123/568.12, 568.17
See application file for complete search history.

(56) References Cited

U.S. PATENT DOCUMENTS

| | | | | |
|---|---|---|---|---|
| 2,633,837 | A * | 4/1953 | Godfrey | 123/568.17 |
| 4,445,487 | A * | 5/1984 | Higashi | 123/568.17 |
| 4,461,150 | A * | 7/1984 | Grohn | 60/605.2 |
| 5,207,714 | A * | 5/1993 | Hayashi et al. | 123/568.17 |
| 5,957,116 | A * | 9/1999 | Haegele et al. | 123/568.12 |
| 6,237,336 | B1 * | 5/2001 | Feucht et al. | 60/605.2 |
| 6,513,508 | B2 * | 2/2003 | Fischer et al. | 123/568.17 |
| 6,672,292 | B2 * | 1/2004 | Fischer | 123/568.17 |
| 7,069,918 | B2 * | 7/2006 | Mackey et al. | 123/568.12 |
| 7,389,770 | B2 * | 6/2008 | Bertilsson et al. | 123/568.17 |
| 2010/0077996 | A1 | 4/2010 | Pantow et al. | |

FOREIGN PATENT DOCUMENTS

| | | |
|---|---|---|
| EP | 1577536 A2 | 9/2005 |
| EP | 1870591 | 12/2007 |
| EP | 1911946 | 4/2008 |
| EP | 2169208 | 3/2010 |
| FR | 2879262 | 6/2006 |

OTHER PUBLICATIONS

EP search report EP 10 16 3112, Sep. 2010.

* cited by examiner

*Primary Examiner* — Thomas Moulis
(74) *Attorney, Agent, or Firm* — James Hasselbeck

(57) ABSTRACT

A self-cooling exhaust gas injection device making it possible to inject heated gases, for example recycled exhaust gases from an internal combustion engine, into the air intake distributor of this engine, characterized in that it comprises a return pipe for the exhaust gases (1) which extends in the distributor (2) to the downstream end thereof in the direction of the transfer of the recycled gasses and is equipped in this area with a series of outlet orifices (4) positioned so as to uniformly distribute these gases between each of the cylinders of the engine.

8 Claims, 1 Drawing Sheet

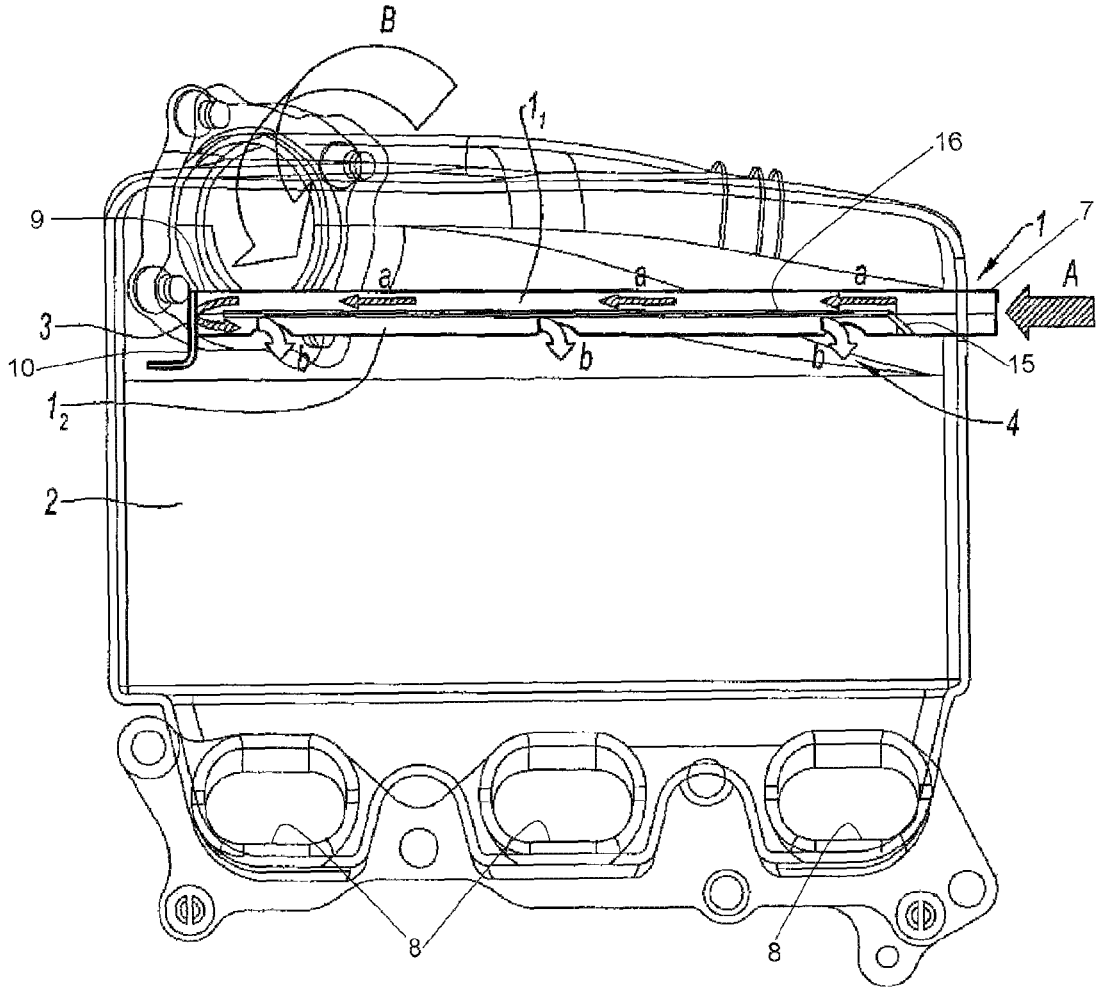
B
$1_1$
16
9
1
7
A
a
a
a
3
10
b
b
b
15
$1_2$
4
2
8
8

SELF-COOLING EXHAUST GAS RECIRCULATION DEVICE FOR AN INTERNAL COMBUSTION ENGINE

CROSS REFERENCE TO RELATED APPLICATIONS

Priority is claimed based on foreign patent application FR 09 53 265 filed in France on May 18, 2009, the entire disclosure of which is incorporated herein by reference.

TECHNICAL FIELD

This disclosure relates to a self-cooling gas injection device for the air distributor or intake manifold of an internal combustion engine and, in particular, to a self-cooling exhaust gas recirculation device.

BACKGROUND OF THE INVENTION

The subject of the present invention is an exhaust gas recirculation device for an internal combustion engine. Many internal combustion engines and the majority of diesel engines are equipped with exhaust gas recirculation devices. Exhaust gas recirculation devices makes it possible to recycle a part of the exhaust gas from the engine into the air intake distributor thereof. The proportion of the gasses thus recycled is of order 5 to 50% as a general rule.

An exhaust gas recirculation device, usually called EGR, more specifically has the function of reducing the pollution generated by internal combustion engines so as to satisfy the standards imposed by regulatory authorities. Such pollution limiting regulations tend to become stricter over time.

The recirculation of a part of the exhaust gases from an engine slows the combustion of the gaseous mixtures supplying the cylinders and absorbs a part of the calories (heat), thereby reducing the combustion temperature.

Further, the presence of an EGR device leads to a limitation of the quantity of oxygen present in the cylinders.

These two effects combine leading to a reduction of the nitrogen oxides (NOx), which are the origin of atmospheric pollution by ozone.

Engine exhaust gas recirculation however has the disadvantage of increasing the production of polluting particles, particularly in the case of diesel engines. It is therefore necessary to find a compromise between the reduction of the nitrogen oxides NOx and the increase of the polluting particle emissions.

For this purpose, it currently is proposed to cool the gasses before they enter into the air intake distributor. In fact, the reduction of the temperature of these gases makes it possible to notably lower the particulate pollution for the same proportion of recycled gasses.

Subsequently, the exhaust gas recirculation devices currently offered on the market comprise a pipe for return of these gases to the intake distributor provided with a heat exchanger, as a general rule equipped with a cooling water circuit.

However, the presence of a heat exchanger has the disadvantage of notably increasing the cost of the EGR devices.

Therefore, there remains a need in the art for an exhaust gas recirculation device configured to provide cooling of recycled gases without requiring the use of a heat exchanger.

SUMMARY OF THE INVENTION

It is an object of the present invention to provide an exhaust gas recirculation device configured to use fresh air supplying the engine air intake distributor (also called an intake manifold) in order to provide passive cooling of the recycled gases, thereby freeing the EGR device from the presence of an additional heat exchanger for cooling these gases.

According to the present inventive disclosure, the EGR device is characterized in that it includes a return pipe extending within the air intake distributor and is equipped in this area with a series of outlet orifices positioned at the downstream end thereof in the direction of the transfer of the recycled gases so as to uniformly distribute these gases between each of the cylinders of the engine.

The exhaust gas return pipe advantageously continues, at its downstream end, into the internal part of the intake distributor by a first segment making it possible to cool the recycled gasses, and then by a second segment equipped with outlet orifices making it possible to introduce the gasses thus cooled into the intake distributor.

As a general rule the recycled gas return pipe is made of steel or stainless steel.

Beyond the possibility of directly introducing the recycled gasses into the intake distributor, without prior cooling, the device conforming to the invention has the advantage of making it possible to use a plastic distributor, therefore less costly, in particular in the case of diesel engines in which, without cooling, the recycled gasses would increase the internal temperature of the distributor to about 250° C.

Further, a single plastic intake distributor can thus be used for engines not equipped with an exhaust gas recirculation device and for engines equipped with such a device, even if the recycled gasses are directly introduced into this distributor, without prior cooling.

Independently of the proceeding, many engines, both diesel and gasoline, are equipped with turbochargers which make it possible to meaningfully increase the quantity of gaseous mixtures supplying the cylinders and therefore the engine power.

Conventionally these systems comprise a first turbine which is driven by the exhaust gases from the engine and which actuates a second turbine mounted on the same shaft so as to compress the gasses supplying the intake distributor.

This compression leads to a notable heating of these gases.

It was subsequently proposed to mount a compressed air cooling element on the inner part of the intake distributor.

In the case of an engine thus equipped, the device conforming to the invention makes it possible to use this cooling element for cooling not only the compressed air coming from the turbocharger, but also the recycled gasses.

It should additionally be noted that in the case of gasoline engines equipped with aluminum air intake distributors, the implementation of passive cooling of recycled gasses, conforming to the invention, can also prove necessary considering that the very high temperature of these gases can reach up to 800° C.

In multiple aspects of the invention, a self-cooling exhaust gas injection device is provided for distributing exhaust gases into an air intake distributor of an internal combustion engine. The self-cooling exhaust gas injection device include a return pipe configured to inject thermally warm, heated or hot gases into an interior of an air intake distributor of an internal combustion engine. The return pipe extends across at least a portion of an interior length of the distributor to a downstream end of the return pipe. The return pipe includes at least one outlet orifice through the wall of the return pipe, the outlet orifices are configured and positioned to uniformly distribute the injected gases into the intake air distributor between each cylinder of the engine.

In at least one aspect of the invention, the return pipe includes a first return pipe segment configured to passively cool the heated injection gases by exposure to the cooling effects of a fresh air supply entering the distributor and flowing about an exterior of the first return pipe segment in the air intake distributor. The return pipe further includes a second return pipe segment downstream of the first segment and equipped with the outlet orifices, the orifices distributing passively cooled injected gases between each cylinder of the engine.

In at least one aspect of the invention the air intake distributor comprises plastic.

In another aspect of the invention, the injected heated gases are recycled exhaust gases from the engine.

In at least one aspect of the invention, the first segment and the segment are arranged in a side by side parallel configuration relative to other with each of the first and second segments extending substantially across the interior length of the air intake distributor.

In another aspect of the invention, an internal combustion engine includes a self-cooling gas injection device according to the present inventive disclosure. A turbocharger is connected to and supplies compressing gases to the return pipe of the self-cooling gas injection device. The compressed gases heated by the turbocharger are at least partially cooled by the self-cooling gas injection device before injection into the distributor.

The above features and advantages and other features and advantages of the present invention are readily apparent from the following detailed description of the best modes for carrying out the invention when taken in connection with the accompanying drawings.

BRIEF DESCRIPTION OF THE DRAWINGS

The accompanying FIGURE serves to further illustrate embodiments and to explain various principles and advantages all in accordance with the present invention.

Features of the present invention, which are believed to be novel, are set forth in the drawing and more particularly in the appended claims. The invention, together with the further objects and advantages thereof, may be best understood with reference to the following description, taken in conjunction with the accompanying drawing. The drawing shows a form of the invention that is presently preferred; however, the invention is not limited to the precise arrangement shown in the drawing.

The single drawing FIGURE is a schematic diagram of an air intake distributor equipped with an exhaust gas recirculation device consistent with the present invention.

Skilled artisans will appreciate that elements in the figures are illustrated for simplicity and clarity and have not necessarily been drawn to scale. For example, the dimensions of some of the elements may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to an exhaust gas recirculation device for an internal combustion engine. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

According to the FIGURE, the exhaust gas recirculation device includes a return pipe 1. Exhaust gases A enter the return pipe 1 through the upstream end 7 which may be advantageously arranged at the exterior of the intake distributor 2 (also referred to herein as an intake manifold). The exhaust gases continue through the return pipe 1 to be injected into the air intake distributor 2 and eventually flow to the intake cylinder riser pipes 8, leading to respective cylinders of the engine.

According to the example shown in the FIGURE, the exhaust gas flow path of the return pipe 1 is U-shaped and comprises two contiguous parallel sections extending substantially over the entire length of the distributor 2, the return pipe 1 specifically including an upstream section $\mathbf{1}_1$ (also referred to herein as a first return pipe segment) and a downstream section $\mathbf{1}_2$, (also referred to herein as a second return pipe segment). These two sections $\mathbf{1}_1$, $\mathbf{1}_2$ are closed in the area of the junction thereof, such as possibly by a bulkhead 3 forming a baffle closing off the end of the return pipe 1.

In the illustrated embodiment, the return pipe 1 is an elongated cylindrical pipe having a dividing wall member 15 inserted into the interior of the return pipe 1. The dividing wall member has a width substantially matching the interior diameter of the return pipe 1 so as to divide the upstream section from the downstream section such that gases cannot flow between the upstream and downstream sections by flowing between the dividing wall member and the interior wall of the return pipe.

As can be seen in the FIGURE, the dividing wall extends within the return pipe 1 along a portion of the return pipe having the outlet orifices 4. The dividing wall member 16 at one end includes a leg member 15 configured to close off one end of the downstream section.

A support bracket 10 may be secured to an interior wall of the intake distributor 2 and support the downstream end 9 of the return pipe 1 in a position spaced apart from interior walls of the intake distributor 2. In this way a fresh air supply or intake air stream B entering the intake distributor 2 is free to flow over the downstream end 9 of the return pipe 1 providing additional surface area exposure of the return pipe 1 to the intake air stream for cooling.

In an alternate embodiment, the return pipe 1 is an elongated tubular pipe having a U-shape. In this embodiment one leg of the U-shape forms the upstream section and the other leg of the U-shape forms the downstream section of the return pipe 1. In this embodiment the bottom of the 'U' of the U-shape forms the closed downstream end 9. A support bracket 10 may be provided to support the downstream end 9 of the return pipe 1 in a position spaced apart from interior walls of the intake distributor 2.

The recycled gases circulating in the first section $\mathbf{1}_1$ of the return pipe 1 flowing according to the arrows A are cooled by fresh air supply (also referred to herein as the intake air stream) in the distributor flowing according to the arrow B before the recycled gasses undergo a change in direction in the area of the bulkhead 3 or the closed downstream end 9 and enters into the second section $\mathbf{1}_2$ of the return pipe 1.

The second section $\mathbf{1}_2$ is equipped with outlet orifices 4 which introduces or injects the now cooled recycled gases into the intake air distributor 2, flowing according to the arrows b.

Consistent with the non-limiting example of the provided drawing FIGURE, the specific engine illustrated in the FIGURE is equipped with three cylinders and the second section $\mathbf{1}_2$ of the return pipe 1 is similarly equipped with three outlet orifices 4 associated with each of the cylinders (air intake ducts to each cylinder shown) and positioned so as to uniformly distribute the recycled gases between the cylinders. The illustrated number of engine cylinders is arbitrary and is not be construed as limiting.

The air intake distributor 2 may include intake cylinder riser pipes 8 with each pipe leading to the intake air valve(s) of a respective cylinder of an internal combustion engine.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. A self-cooling exhaust gas injection device for distributing exhaust gases into an air intake distributor of an internal combustion engine, comprising:

a return pipe injecting said exhaust gases into an interior of said intake distributor, said return pipe having an upstream end receiving exhaust gases and an opposing closed downstream end, said return pipe extending across at least a portion of an interior length of said distributor; and said return pipe including at least one outlet orifice, said outlet orifices distributing said injected gases into an intake air stream surrounding said return pipe within said intake distributor;

wherein said intake air stream flows over and completely surrounds all sides of said return pipe with the exception of said upstream end;

wherein said outlet orifices are configured and positioned to uniformly distribute said injected gases into said intake air stream to each intake cylinder riser pipe;

wherein said return pipe comprises:

a first return pipe segment configured to passively cool said exhaust gases by exposure to said intake air stream entering said distributor and flowing about an exterior of said first return pipe segment in said air intake distributor; and a second return pipe segment receiving passively cooled exhaust gases from said first return pipe segment, said second return pipe segment equipped with said outlet orifices.

2. The self-cooling exhaust gas injection device according to claim 1, wherein the air intake distributor comprises plastic.

3. The self-cooling exhaust gas injection device according to claim 1, wherein said first segment and said second segment are arranged in a side by side parallel configuration with each other, each of said first and second segments extending substantially across said interior length of said air intake distributor .

4. The self-cooling exhaust gas injection device according to claim 3, wherein said return pipe is an elongated cylindrical pipe further comprising:

a dividing wall member inserted into said return pipe and dividing an interior of said return pipe into said first return pipe segment and said second return pipe segment;

wherein said dividing wall member is spaced apart from said closed downstream end permitting exhaust gases to flow from said first return pipe segment to said second return pipe segment within said return pipe;

wherein said dividing wall member extends within said return pipe along a portion of said return pipe having said outlet orifices;

wherein exhaust gases in said second return pipe segment flows in an opposite direction to exhaust gas flow in said first return pipe segment; and wherein said dividing wall member includes a leg member closing off one end of said second return pipe segment within said return pipe.

5. The self-cooling exhaust gas injection device according to claim 4, wherein a support bracket is secured to an interior of said intake distributor and supports said downstream end in a position spaced apart from interior walls of said intake distributor, said spaced position permitting said intake air stream to flow over said downstream end.

6. The self-cooling exhaust gas injection device according to claim 3, wherein said return pipe is an elongated tubular pipe having a U-shape;

wherein one leg of said U-shape forms said first return pipe segment and a second leg of said U-shape form said second return pipe segment; and wherein said closed downstream end of said return pipe is formed by a bottom of said 'U' of said U-shape.

7. The self-cooling exhaust gas injection device according to claim 6, wherein a support bracket is secured to an interior of said intake distributor and supports said downstream end in a position spaced apart from interior walls of said intake distributor, said spaced position permitting said intake air stream to flow over said downstream end.

8. An internal combustion engine comprising:

a self-cooling gas injection device according to claim 1; and a turbocharger connected to and supplying compressing gases to said return pipe of said self-cooling gas injection device;

wherein said compressed gases are heated by said turbocharger; and wherein said self-cooling gas injection device at least partially cools said compressed turbocharger gases before injection into said distributor.

* * * * *